US007530409B2

(12) United States Patent
Kennedy et al.

(10) Patent No.: US 7,530,409 B2
(45) Date of Patent: May 12, 2009

(54) ROTARY ROLLER REAMER

(75) Inventors: John Francis Kennedy, St Agnes (AU); Mathew John Kennedy, Holden Hill (AU); Michael Desmond Slattery, Paradise (AU)

(73) Assignee: Extreme Machining Australia Pty Ltd. (AU)

( * ) Notice: Subject to any disclaimer, the term of this patent is extended or adjusted under 35 U.S.C. 154(b) by 554 days.

(21) Appl. No.: 11/122,782

(22) Filed: May 4, 2005

(65) Prior Publication Data

US 2005/0252694 A1 Nov. 17, 2005

Related U.S. Application Data

(63) Continuation of application No. PCT/AU03/01485, filed on Nov. 7, 2003.

(30) Foreign Application Priority Data

Nov. 7, 2002 (AU) ..... 2002952522
Feb. 13, 2003 (AU) ..... 2003900650
May 7, 2003 (AU) ..... 2003902189

(51) Int. Cl.
*E21B 10/22* (2006.01)

(52) U.S. Cl. ..... 175/371; 175/228

(58) Field of Classification Search ..... 175/228, 175/344, 345, 346, 347, 348, 354
See application file for complete search history.

(56) References Cited

U.S. PATENT DOCUMENTS 2,122,763 A 7/1938 Smith
2,189,032 A 2/1940 Carleton
2,189,038 A 2/1940 Jones
2,328,735 A 9/1943 Miller
2,716,020 A 8/1955 Blaker
2,742,264 A 4/1956 Snyder
3,056,637 A 10/1962 Shanley et al.
3,306,381 A 2/1967 Garrett et al.
3,659,663 A 5/1972 Dysart
3,719,241 A 3/1973 Bell
3,818,999 A 6/1974 Garrett
3,820,613 A 6/1974 White
3,866,695 A 2/1975 Jackson et al.
3,907,048 A 9/1975 Gray
3,917,361 A 11/1975 Murdoch et al.
3,980,309 A 9/1976 Dechavanne
4,013,325 A 3/1977 Rear
4,182,425 A * 1/1980 Garrett ..... 175/228

(Continued)

FOREIGN PATENT DOCUMENTS

AU 522206 11/1981

(Continued)

*Primary Examiner*—William P Neuder
(74) *Attorney, Agent, or Firm*—Knobbe Martens Olson & Bear LLP

(57) ABSTRACT

The invention relates to a roller assembly for a rotary roller reamer. The roller assembly includes a roller pin and a crushing roller. The crushing roller is arranged to be mounted on the roller pin and to rotate thereabout. The roller assembly is connected together so as to form a single cartridge which can be inserted into a pocket of the rotary roller reamer and secured thereto using a single fastener device.

21 Claims, 13 Drawing Sheets

U.S. PATENT DOCUMENTS

| | | | | | |
|---|---|---|---|---|---|
| 4,261,426 | A | * | 4/1981 | Garrett | 175/228 |
| 4,262,760 | A | * | 4/1981 | Allison et al. | 175/347 |
| 4,499,642 | A | | 2/1985 | Vezirian et al. | |
| 4,508,184 | A | * | 4/1985 | Hansen | 175/346 |
| 4,526,387 | A | | 7/1985 | Flower | |
| 4,548,284 | A | * | 10/1985 | Shinn et al. | 175/346 |
| 4,561,508 | A | * | 12/1985 | Garrett | 175/347 |
| 5,381,868 | A | * | 1/1995 | Schock | 175/346 |

FOREIGN PATENT DOCUMENTS

| | | | |
|---|---|---|---|
| AU | 594885 | | 1/1989 |
| AU | 675186 | | 5/1995 |
| EP | 0 248 615 | A | 12/1987 |
| EP | 0 274 265 | A2 | 7/1988 |
| EP | 0 509 157 | A1 | 4/1991 |
| GB | 2349658 | A | 11/2000 |
| WO | WO 95/13452 | | 5/1995 |

* cited by examiner

ROTARY ROLLER REAMER

CROSS REFERENCE TO RELATED APPLICATIONS

This application is a continuation of PCT/AU2003/001485, filed on Nov. 7, 2003, which application is hereby incorporated by reference in its entirety.

BACKGROUND OF THE INVENTION

1. Field of the Invention

The present invention relates to an improved rotary roller reamer and to improvements to the various components thereof.

2. Description of the Related Art

During drilling operations, the drill bit is subject to wear and thus the dimension of the drill hole will vary over time. To ensure that the dimension of the drill hole is held true, rotary roller reamers are located in the drill string and are used to ream out the drill hole to the required dimension. The inclusion of rotary roller reamers in the drill string enables the drill bit to be used for a longer period without changeover and this prevents considerable costly downtime.

The working environment of rotary roller reamers is very harsh. Consequently, the components of the roller reamer frequently need servicing, repair or replacement. As downtime for repairs is very costly, it is advantageous to extend the working life of such roller reamers and to thereby reduce down time due to repairs. It is also advantageous for the roller assemblies used in rotary roller reamers to be quickly and easily removed and replaced from their respective pockets in the reamer body.

The present invention seeks to provide an improved rotary roller reamer and various components thereof.

The present invention also seeks to provide a pressure equalizer for a device.

SUMMARY OF THE INVENTION

According to a first aspect of the present invention there is provided a rotary roller reamer including a reamer body having at least one pocket for receiving a roller assembly and wherein said roller assembly includes a plurality of components which are connected together to form a single cartridge which can be inserted into said pocket.

Preferably, said cartridge is secured in said pocket by a single fastener device.

According to a second aspect of the invention there is provided a roller assembly for a rotary roller reamer, said roller assembly including a roller pin and a crushing roller arranged to be mounted on said roller pin and to rotate thereabout, and wherein the roller assembly is connected together so as to form a single cartridge which can be inserted into a pocket of the rotary roller reamer.

Preferably, the cartridge is arranged to be secured to the pocket by a single fastener device.

Preferably, said roller assembly further includes a first retainer for retaining said roller pin within said pocket, said first retainer including a first plug which is arranged to be connected to the roller pin so that the roller pin, crushing roller and first plug form said single cartridge which can be inserted into the pocket of the rotary roller reamer.

Preferably, the first plug has a first surface against which a first end of the roller pin mates and a second surface arranged to engage with a sidewall of said pocket, said sidewall of said pocket and said second surface of said first plug being configured so that the first plug is drawn into the pocket when said fastener device is used to secure the roller assembly to said pocket.

Preferably, the roller assembly further includes a second retainer.

Preferably, a first thrust ring is provided between the roller pin and a first end of the crushing roller and a second thrust ring is provided between a second end of the crushing roller and said second retainer. The first and second thrust rings are preferably sacrificial thrust rings arranged to accommodate thrust loads applied to the crushing roller during use of the rotary roller reamer.

Preferably, the first surface of the first plug is complimentary to the first end of the roller pin. The first end of the roller pin is preferably formed with an enlarged head.

The roller pin preferably includes a shank having central longitudinal blind bore formed therein that opens through a second end of the roller pin. The bore forms a lubricant reservoir. The bore opens into a side port that extends substantially perpendicular thereto and opens into a primary lubricant distribution groove. The primary lubricant distribution groove preferably extends substantially longitudinally of the roller pin and may adopt various configurations, for example, a "FIG. 8" configuration.

Lubricant can be supplied from the reservoir, through the side port and into the primary lubricant distribution groove during rotation of the crushing roller about the roller pin. The lubricant is distributed over the shank of the roller pin as the crushing roller rotates thereabout.

Seal are preferably provided between the crushing roller and the shank of the roller pin to prevent escape of lubricant.

Preferably, pressure equalizer is provided in the bore of the roller pin. The pressure equalizer is arranged to equalize the pressure between the drilling mud surrounding the body of the rotary roller reamer and the lubricant contained in the bore of the roller pin. The pressure equalizer may include a filter, such as a sintered metal filter.

In a preferred embodiment, the first plug is formed as a frustum having a base and a top. The frustum preferably has an angle of less than or equal to 7° to its central longitudinal axis. Preferably, this angle is approximately 3°. The base of the first plug is arranged to be positioned uppermost in the pocket. The base has an outer diameter which is smaller than the outer diameter of the top.

The base of the first plug has an underside that is preferably shaped to engage with a mating portion of the pocket. The mating portion of the pocket preferably includes a post that includes a central threaded bore that is arranged to enable the fastener to be screwed there into.

The first plug preferably includes a fastener-receiving cavity that opens through a sidewall of the first plug and also into the base of the first plug. The cavity is configured so that the fastener can be passed through the opening in the sidewall and located there within. In this position, the leading end of the fastener extends through the opening in the base. In this manner, the leading end of the fastener can be screwed into the threaded bore formed in the post of the pocket.

The first plug preferably also includes an elongate screw connector slot formed in the sidewall thereof. The screw connector slot being configured to receive the head of a screw connected to the enlarged head of the roller pin.

An aperture is preferably formed in the top of the first plug and is arranged so that a tool can be passed there through to enable the fastener to be screwed into the bore of the post.

In a particularly preferred form, the fastener is a socket head fastener and the socket head is arranged to be located within an upper portion of the fastener-receiving cavity. The upper portion of the cavity is configured so that when the fastener is screwed into the post of the pocket, the first plug is drawn into the pocket, and when the fastener is unscrewed, the first plug is lifted out of the pocket.

The second retainer preferably includes a second plug which is formed as a frustum. The frustum preferably has an angle of less than or equal to 7° to its central longitudinal axis. Preferably, the angle is approximately 3°. The second plug has a base, a top and a side wall. The base has a larger outer diameter than the top and is arranged to be positioned lowermost within the pocket.

A bore is formed in the second plug substantially perpendicular to the central longitudinal axis of the second plug. The bore is arranged to receive the second end of the roller pin. Preferably, the bore is sized for a sliding fit with the second end of the roller pin.

A minor bore is also preferably provided in the sidewall of the second plug. The minor bore is arranged to aid pressure equalization between the lubricant contained in the lubricant reservoir and the mud surrounding the roller assembly during use thereof.

Extending from the side wall of the second plug is a lug. The lug is arranged to engage with a complimentary shaped recess formed in a portion of the pocket.

In accordance with a preferred embodiment of the invention, each pocket of the rotary roller reamer includes a lower tapered socket, a primary cavity, a secondary cavity and an upper tapered socket. The upper tapered socket is preferably located at the up hole end of the rotary roller reamer and the lower tapered socket is preferably located at the down hole end of the rotary roller reamer.

The upper tapered socket is arranged to receive the first retainer. The upper tapered socket includes a semi-circular truncated conical seat of less than or equal to 7° angle to a normal axis of the socket (i.e. the axis normal to the longitudinal axis of the rotary roller reamer). Preferably, the angle is approximately 3°. The socket is tapered so that the smaller diameter of the socket forms part of the floor of the pocket. Tangential to the conical seat is an entrance guide-way having sides matching the taper of the conical seat. The seat extends for approximately 270° arc length, with the remainder of the arc length opening into the secondary cavity. Preferably, the seat extends for greater than 180° arc length.

Located substantially centrally of the upper tapered socket is the post in which the fastener of the first plug is preferably arranged to be secured.

The primary cavity (or roller cavity) is preferably configured to provide operating clearance for the crushing roller mounted on the roller pin. The primary cavity is necked down as compared to the external diameter of the reamer body. This results in the primary cavity having a depth in the direction normal to the longitudinal axis of the reamer body which is less than the depth of the upper and lower tapered sockets.

The secondary cavity is preferably formed as a flanked trapezium shape which narrows at the floor of the cavity. The secondary cavity forms a seat for the head of the roller pin.

The lower tapered socket is preferably arranged to receive the second retainer. The lower tapered socket includes a semi-circular truncated conical seat of less than or equal to 7° angle to a normal axis of the socket (i.e. the axis normal to the longitudinal axis of the rotary roller reamer). Preferably, the angle is approximately 3°. The socket is tapered so that the larger diameter of the socket forms part of the floor of the pocket.

Located in the sidewall portion of the lower tapered socket is a groove or ledge arranged to receive the security lug of the second plug. The groove or ledge is preferably substantially crescent shaped.

According to a third aspect of the invention there is provided a crushing roller for a rotary roller reamer, said crushing roller including a central portion and first and second end portions, the central portion having an external diameter greater than the external diameter of the first and second portions, and wherein the central, first and second portions are studded with projections.

The projections are preferably arranged on the central portion so that a contact area of the projections with a portion of a wall of a drill hole being reamed overlaps. The projections may be arranged on at least one helix about the central portion of the crushing roller. The helix may advantageously be a left hand helix. Such an arrangement serves to reduce the thrust loading in the vertical plane during use of the crushing roller.

Preferably, each projections includes a button mounted in a hole formed in the crushing roller. The button is preferably a domed shaped tungsten carbide button.

In accordance with one preferred form, the buttons on the central portion are arranged in four rows of eight and are set on a left-hand 3.31699" pitch helix. Each row is separated by 90° of angular rotation and the starting point for each row commences in a progressive step equal to $0.125\times\frac{1}{9}^{th}$ of the helical datum curve length. Each projections is spaced at $\frac{1}{9}^{th}$ of the helical curve length.

Preferably, located between each of the helically spaced rows are flutes which are generated on the same helical datum path as the projections. The flutes are arranged to provide an increased mud flow past the roller and increase the clearance through which the residue from the reamer can pass.

According to a fourth aspect of the present invention there is provided a rotary roller reamer including a reamer body having at least one pocket for receiving a roller assembly, said roller assembly including a pin and a crushing roller arranged to be mounted on said pin, seal between the pin and the crushing roller and a retainer for retaining said pin within said pocket, and wherein the pin includes a bore having pressure equalizer located there within, the pressure equalizer serving to substantially equalize the pressure on the seal.

Preferably, the pressure equalizer serves to equalize the pressure between the drilling mud surrounding the body of the rotary roller reamer during use and a lubricant contained in the bore of the roller pin.

The crushing roller is preferably arranged to rotate about the roller pin.

The pressure equalizer may include a filter, such as a sintered metal filter.

According to a fifth aspect of the invention there is provided a rotary roller reamer including a reamer body having at least one pocket for receiving a roller assembly, said roller assembly including a roller pin and a crushing roller arranged to be mounted on said roller pin, wherein the reamer body has a primary outer diameter in an area distal to the crushing roller and a secondary outer diameter in an area adjacent to the crushing roller, and wherein the secondary outer diameter is reduced as compared to the primary outer diameter so as to provide stress relief.

According to a sixth aspect of the invention there is provided a pressure equalizer for a device having at least one seal for sealing a supply of lubricant located between a first and a second member of said device, said pressure equalizer being arranged to be mounted in said device and arranged so that it acts to equalize the pressure applied by the lubricant to a first side of said at least one seal with the pressure of a fluid being applied on a second side of the at least one seal.

BRIEF DESCRIPTION OF THE DRAWINGS

Embodiments of the invention will now be described, by way of example only, with reference to the accompanying drawings in which:—

DETAILED DESCRIPTION OF THE PREFERRED EMBODIMENTS

Figure 1:
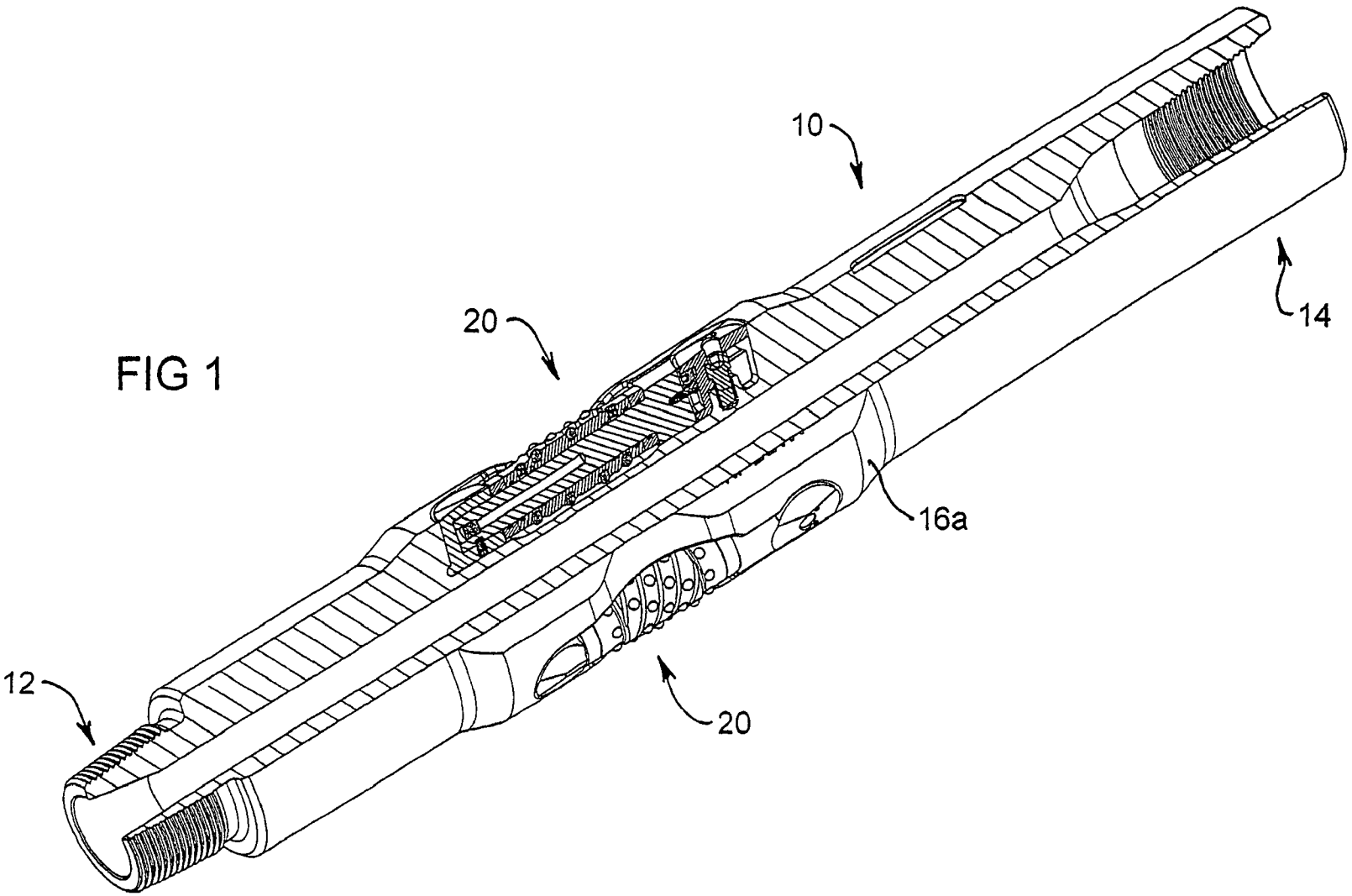
FIG. 1 is a cut-away view of a rotary roller reamer according to an embodiment of the invention.
Figure 1A:
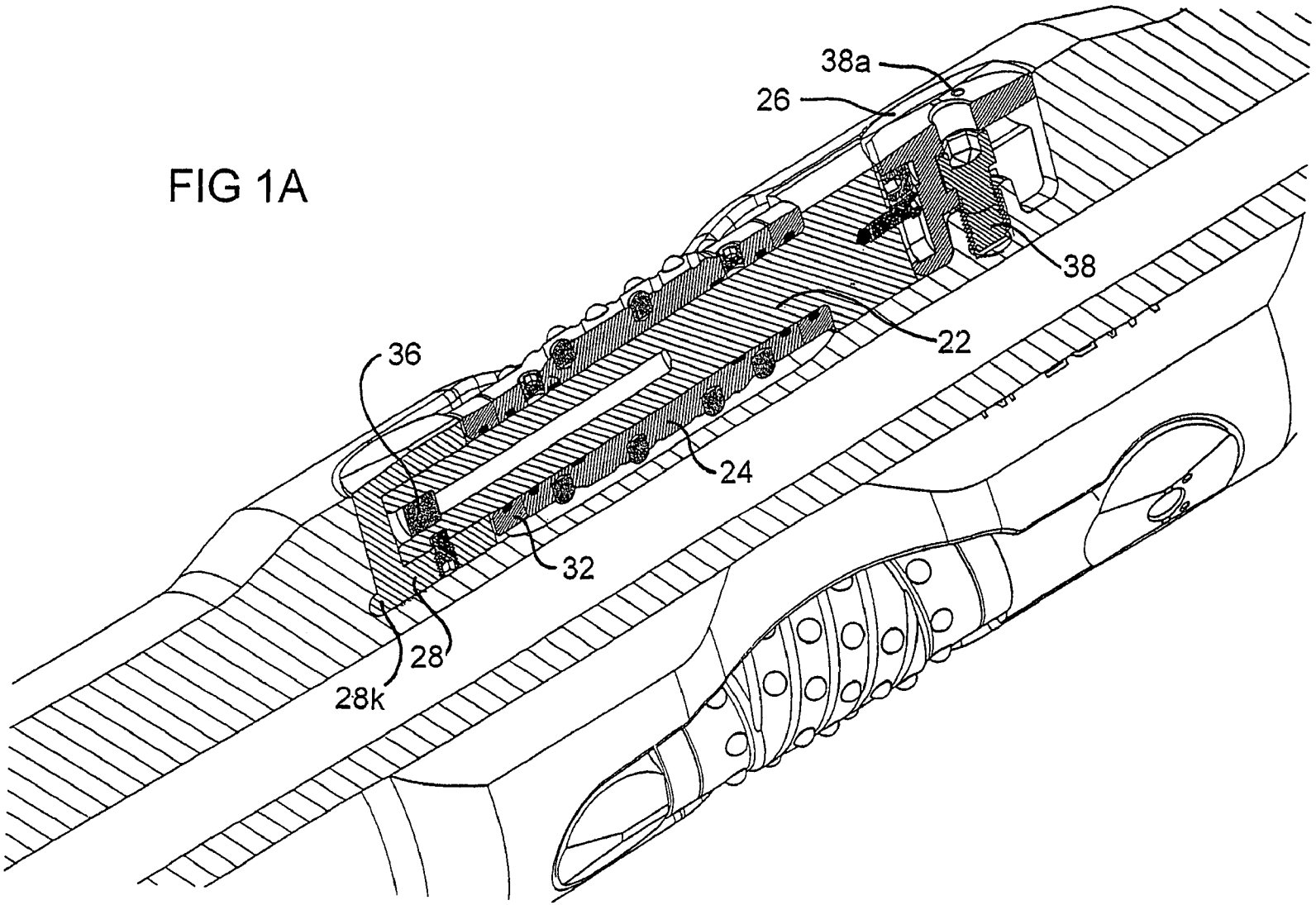
FIG. 1A is an enlarged view of the central portion (i.e. the pocket and the roller assembly) of the rotary roller reamer shown in FIG. 1.

FIGS. 1 and 1A illustrate a rotary roller reamer 10 in accordance with an exemplary embodiment of the invention. The rotary roller reamer 10 has a male end 12 and a female end 14. The rotary roller reamer 10 is arranged to be attached to a drill string (not shown). As shown in this embodiment, the male end 12 is located at the down hole end of the rotary roller reamer 10 and the female end 14 is located at the up hole end of the rotary roller reamer 10. It will of course be appreciated that the configuration or nature of the respective ends of the rotary roller reamer 10 may vary.

The rotary roller reamer 10 includes a tubular reamer body 16 which includes three circumferentially spaced pockets 18. Located within each pocket 18 is a roller assembly or roller cartridge 20. The pockets 18 as illustrated are equally spaced about the periphery of the reamer body 16 and are located in a section 16*a* of the body 16 that has a larger outer diameter than the remainder of the body 16. Although three pockets 18 are illustrated, it will be appreciated that arrangements with different numbers of pockets 18 and spacings are envisaged.

Figure 2:
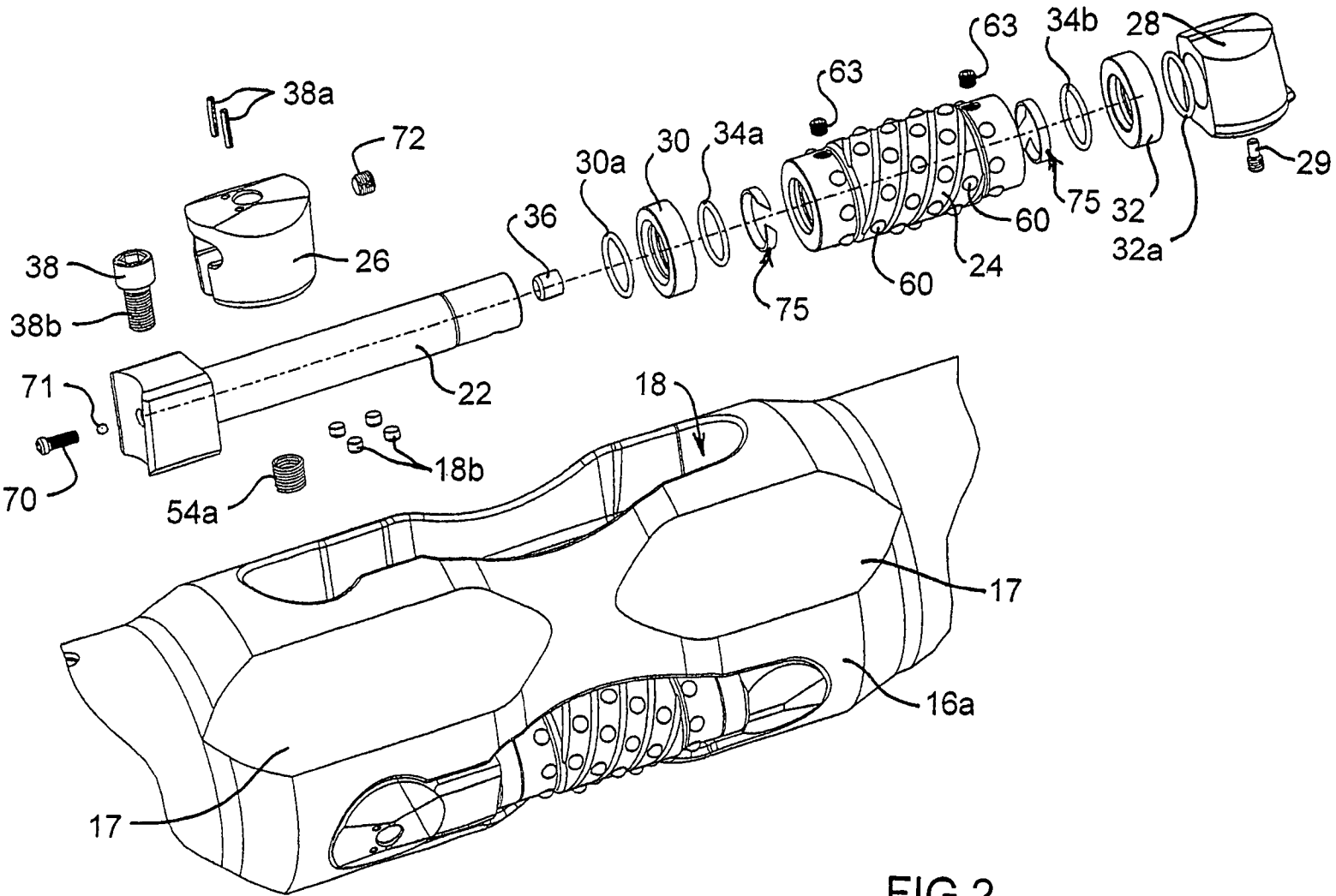
FIG. 2 is a partial assembly view of a roller assembly in accordance with an embodiment of the invention adjacent to a reamer body having multiple pockets.

FIG. 2 better illustrates the pockets 18 formed in the reamer body 16. This figure also illustrates the cut away sections or mud ways 17 formed between adjacent pockets 18.

FIG. 2 illustrates the roller assembly 20 in a disassembled condition. The roller assembly 20 includes a roller pin 22, a crushing roller 24, a first retainer 26, a second retainer 28, a retaining screw 29, a first thrust ring 30, a second thrust ring 32, a pair of seals 34*a*, 34*b*, a pressure equalizer 36, a fastener 38, a pair of self locking pins 38*a*, a connector screw 70 and a retaining plug 72.

When the components of the roller assembly 20 are assembled together they form a single cartridge which can be secured, using the fastener 38, in the pocket 18 of the rotary roller 10. During use, the crushing roller 24 is arranged to rotate about the roller pin 22 so that it can be used to ream the sidewalls of the drill hole through which the rotary roller reamer 10 is passed. The nature of each of the components of the roller assembly 20 and the pockets 18 formed in the reamer body 16 will now be described in more detail.

Figure 3A:
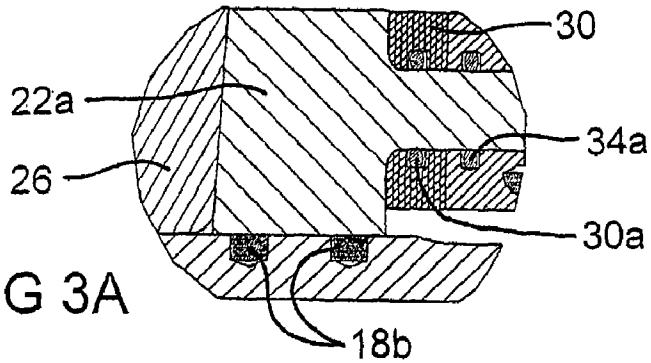
FIG. 3A is a part cross sectional view of one end of the roller assembly along a line offset from the centre line of the rotary roller reamer.
Figure 3:
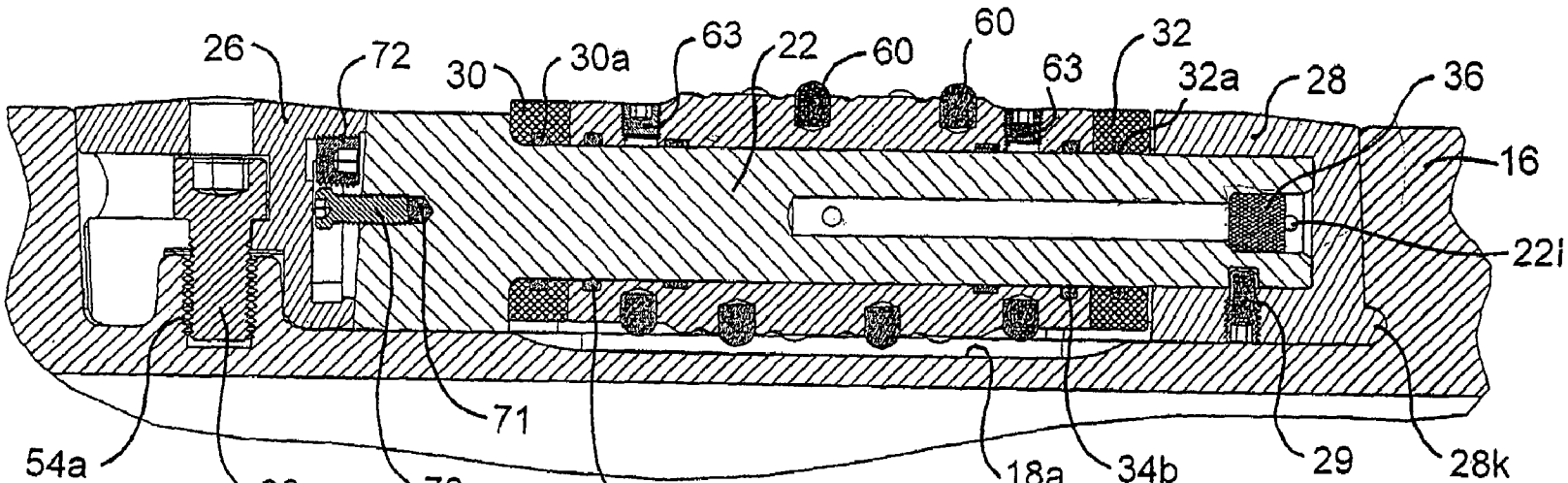
FIG. 3 is a central longitudinal cross sectional view of the roller assembly shown in FIG. 2 mounted in a pocket of a rotary roller.
Figure 4:
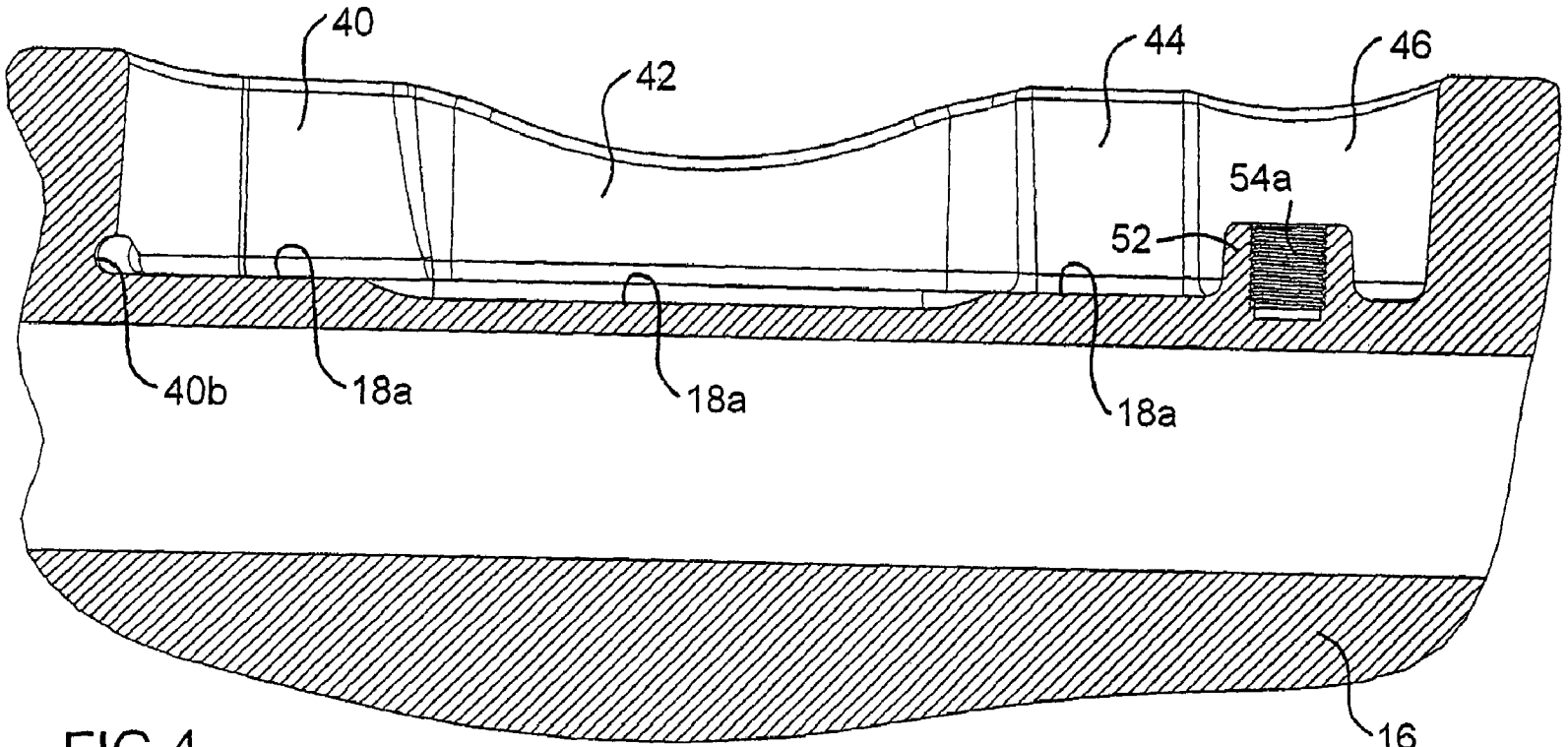
FIG. 4 is a longitudinal cross sectional view of the pocket of the rotary roller reamer shown in FIG. 3.
Figures 5, 6, 7, 8:
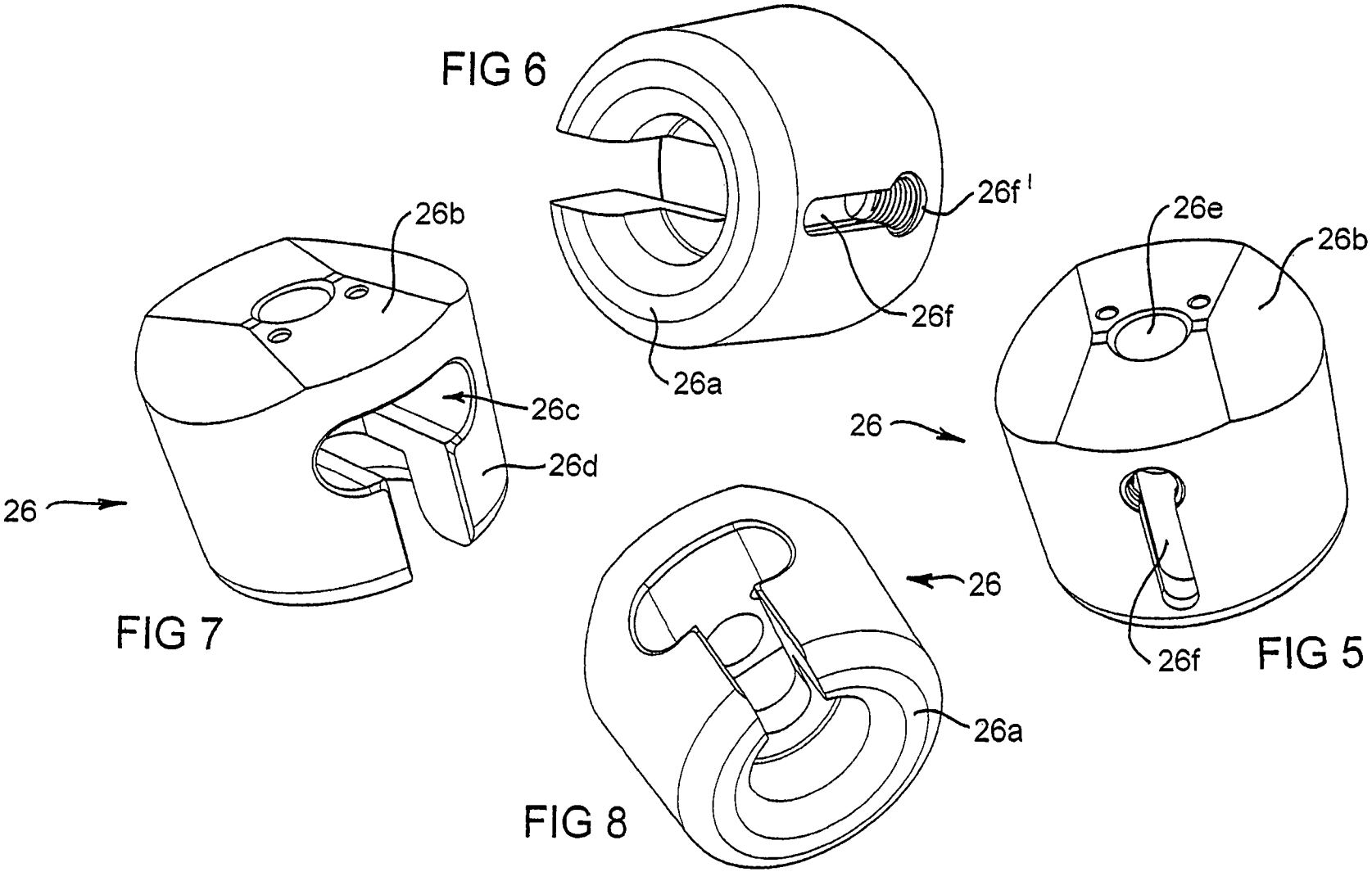
FIGS. 5 to 8 are perspective views of a first retainer in accordance with an embodiment of the invention.

FIGS. 3, 3A and 4 best illustrate the configuration of each of the pockets 18 and the engagement of the roller assembly 20 within its respective pocket 18. Each pocket 18 includes a lower tapered socket 40, a primary cavity 42, a secondary cavity 44 and an upper tapered socket 46. The lower tapered socket 40 is located at the down hole end of the rotary roller reamer 10, whilst the upper tapered socket 46 is located at the up hole end of the rotary roller reamer 10. The lower tapered socket 40 is arranged to receive the second retainer 28, whilst the upper tapered socket 46 is arranged to receive the first retainer 26. The primary cavity 42 is arranged to receive the roller pin 22 and the crushing roller 24 which is mounted thereon. The primary cavity 42 is sized and configured to provide operating clearance for the crushing roller 24 during use of the rotary roller reamer 10. The secondary cavity 44 forms a seat for the head 22*a* of the roller pin 22.

The lower tapered socket 40 includes a semi-circular truncated conical seat of less than or equal to 7° angle to a normal axis of the socket 18 (i.e. the axis normal to the longitudinal axis of the rotary roller reamer 10). As illustrated, this angle is approximately 3°. The lower tapered socket 40 is tapered so that the larger diameter of the socket 40 forms part of the floor 18*a* of the pocket 18. Tangential to the conical seat is an entrance guide way 40*a* having sides matching the taper of the conical seat.

Formed in the lower part of the lower tapered socket 40 and coincident with the floor 18*a* of the pocket 18, is a semi-circular recess 40*b*. This recess 40*b* is a security recess which is arranged to receive a complimentary shaped lug 28*k* formed on the second retainer 28. The function of the security recess 40*b* and the lug 28*k* will be discussed in more detail subsequently.

Installed in a portion of the floor 18*a* of the lower tapered socket 40 so as to be positioned below the head 22*a* of the roller pin 22 are four carbide inserts 18*b*. The carbide inserts 18*b* are provided to prevent wear of the floor 18*a* of the pocket 18 due to movement of the head 22*a* during use of the rotary roller reamer 10.

The primary cavity 42, as clearly illustrated in FIG. 4, is necked down as compared to the external diameter of the reamer body 16. Additionally, the floor 18*a* of the primary cavity 42 steps downwardly in a direction towards the centre line of the reamer body 16. Thus, the primary cavity 42 has a depth in a direction normal to the longitudinal axis that is sufficient to provide working clearance for the crushing roller 24. Additionally, the external diameter of the reamer body 16 in this area is reduced or "necked down" as compared to the external diameter of the reamer body 16 in the areas adjacent to the lower and upper tapered sockets 40, 46. This necked down configuration of the reamer body 16 provides stress relief in the area of the pockets 18.

The secondary cavity 44 is formed with a flanked trapezium shape which narrows at the down hole end of the cavity 44.

The upper tapered socket 46 includes a semi-circular truncated conical seat of less than or equal to 7° angle to the normal axis of socket 46. As illustrated, this angle is approximately 3°. The upper socket 46 is tapered so that the smaller diameter of the socket 46 forms part of the floor 18*a* of the pocket 18. The seat extends for approximately 270° arc length, with the remainder of the arc length opening into the secondary cavity 44. Located substantially centrally of the upper tapered socket 46 is a post 52. The post 52 includes a bore 54 which is threaded so that it can receive the fastener 38. Alternatively, as illustrated, a threaded insert 54*a* may be located in the bore 54.

FIGS. 5 to 8 illustrate the first retainer 26. The first retainer 26 is formed as a first plug 26 and is arranged to be received within the upper tapered socket 46. The first plug 26 is formed as a frustum. The frustum has an angle of less than or equal to 7° to its central longitudinal axis and includes a base 26*a* and a top 26*b*. As illustrated, the frustum has an angle of approximately 3°. The base 26*a* is arranged to be positioned lowermost in the lower tapered socket 46. The base 26*a* has an outer diameter which is smaller than the outer diameter of the top 26*b*. The underside of the base 26*a* is shaped to engage with the floor 18*a* of the pocket 18 in the area of the upper tapered socket 46. In particular, the base 26*a* is shaped so that it will mate with the post 52.

The first plug 26 includes a fastener-receiving cavity 26*c* that opens through a sidewall 26*d* and also into the base 26*a* of the first plug. The cavity 26*c* is configured so that the fastener 38 can be positioned within and so that the leading end 38*b* of the fastener 38 can be secured within the bore 54 formed in the post 52. An aperture 26*e* is located in the top 26*b* of the first plug 26 and is configured so that the working end of a tool can be passed there through. This enables the fastener 38 to be screwed into and out of the bore 54 of the post 52.

Formed in the top 26*a* of the first plug 26 is a pair of bores arranged to receive the self locking pins 38*a*. The self locking pins 38*a* are configured to properly locate and lock the fastener 38 within the fastener-receiving cavity 26*c*.

Figure 19:
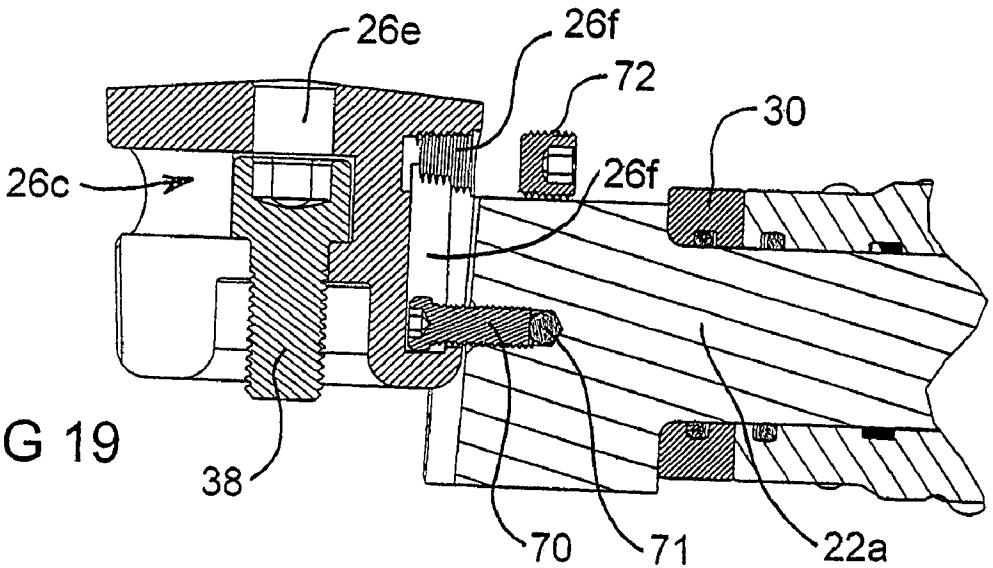
FIG. 19 is cross sectional view showing insertion of the retaining plug in the connector screw slot of the first retainer.

The sidewall 26*d* of the first plug 26 also includes an elongate connector screw slot 26*f* which enables the first plug 26 to be connected to a connector screw 70 which extends from the enlarged head 22*a* of the roller pin 22. The connector screw slot 26*f* includes a threaded upper portion 26*f'* which is arranged to receive a threaded retaining plug 72 (FIG. 19). Prior to receiving the retaining plug 72, the threaded upper portion 26*f'* is sized to enable the head 70*a* of the connector screw 70 to pass there through. In this manner, the head 70*a* of the connector screw 70 can be inserted into the connector screw slot 26*f* and then the shank of the screw 70 can be moved along the length of the slot 26*f*. The connection between the screw 70 and the first plug 26 will be described in more detail subsequently.

As best illustrated in FIG. 3, the fastener 38 is a socket head fastener. The head of the fastener 38 is arranged to be located within an upper portion of the cavity 26*c* so that when the fastener 38 is screwed into the post 52, the first retainer 26 is drawn into the lower tapered socket 46 and when the fastener 38 is unscrewed, the first retainer 26 is lifted out of the upper tapered socket 46. The configuration of the sidewalls of the lower tapered socket 46 and the shape of the head 22*a* of the roller pin 22 facilitate this action of the first retainer 26. As the first retainer 26 (first plug 26) is connected to the roller pin 22, movement of the first plug 26 in and out of the upper tapered pocket 46 will result in movement of the entire roller cartridge 20 in and out of the pocket 18.

Figure 10:
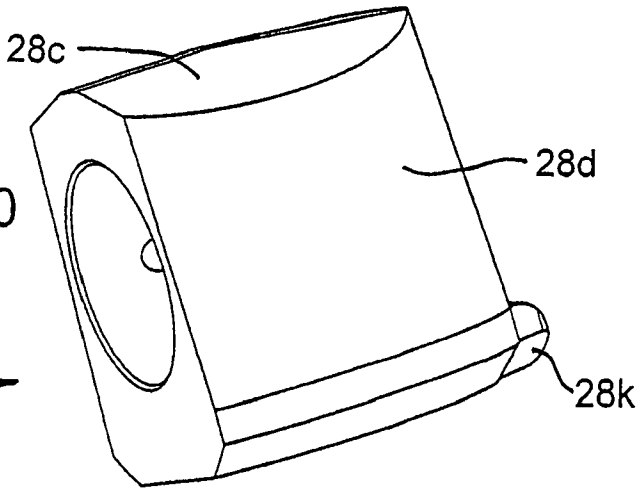
FIGS. 9 to 11 are perspective views of a second retainer in accordance with an embodiment of the invention.
Figure 11:
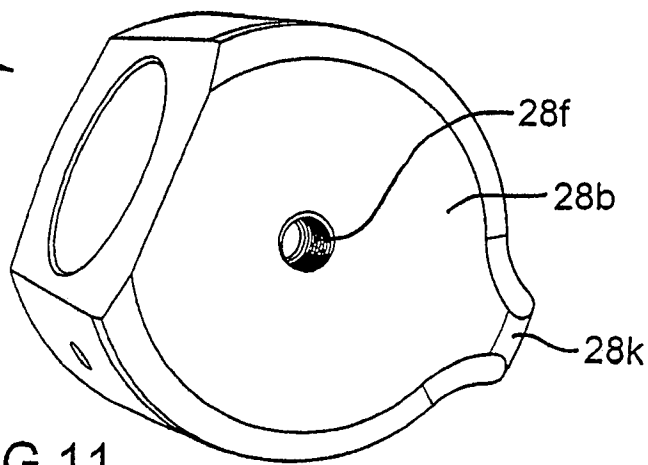
Figure 9:
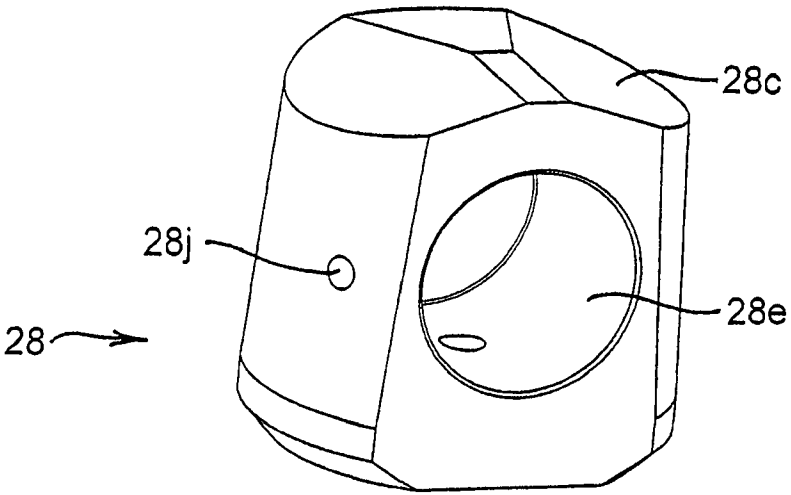

FIGS. 9 to 11 illustrate the second retainer 28. The second retainer 28, or second plug, is formed as a frustum. The frustum has an angle of less than or equal to 7° to its central longitudinal axis. As illustrated, this angle is approximately 3°. The second plug 28 has a base 28*b*, a top 28*c* and a sidewall 28*d*. The base 28*b* has a larger external diameter than the top 28*c* and is arranged for positioning lowermost within the upper tapered socket 40. A bore 28*e* is formed in a flat portion of the sidewall 28*d* of the second plug 28. The bore 28*e* extends substantially perpendicular to the central longitudinal axis thereof. The bore 28*e* is arranged to receive a second end 22*b* of the roller pin 22. The bore 28*e* is sized for a sliding fit with the second end 22*b* of the roller pin 22.

A threaded aperture 28*f* is formed in the base 28*b* of the second plug 28. The threaded aperture 28*f* is arranged to receive a retaining screw 29 which locates the second end 22*b* of the roller pin 22 within the second plug 28. The engagement of the retaining screw 29 with the roller pin 22 will be described in more detail subsequently.

Formed in the sidewall 28*d* of the second plug 28 is a minor bore 28*j*. The function of the minor bore 28*j* will be explained subsequently.

As mentioned previously, the second plug 28 has a lug 28*k* formed on the lower part thereof. The lug 28*k* is arranged to engage within the security recess 40*b* formed in the lower tapered socket 40. This engagement serves to better retain the roller assembly 20 within the pocket 18.

Figure 12:
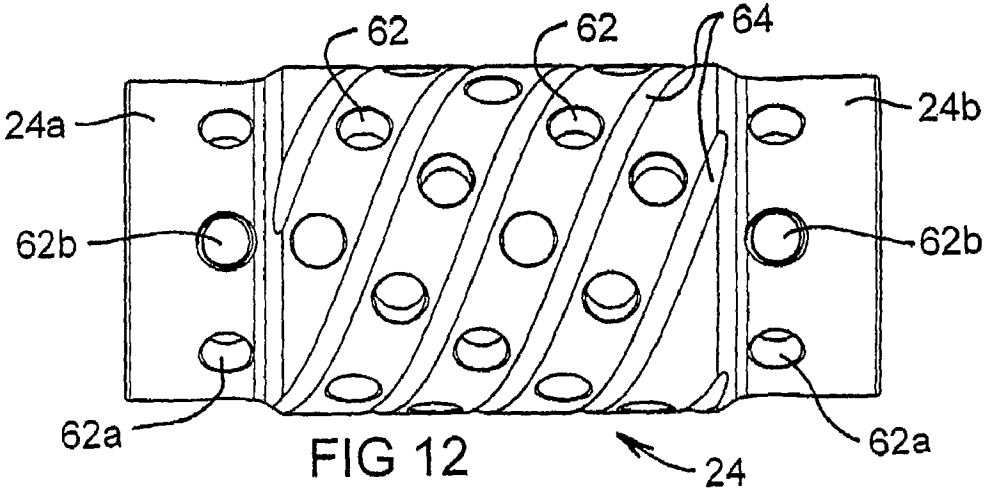
FIG. 12 is a side view of a crushing roller in accordance with an embodiment of the invention.
Figure 13:
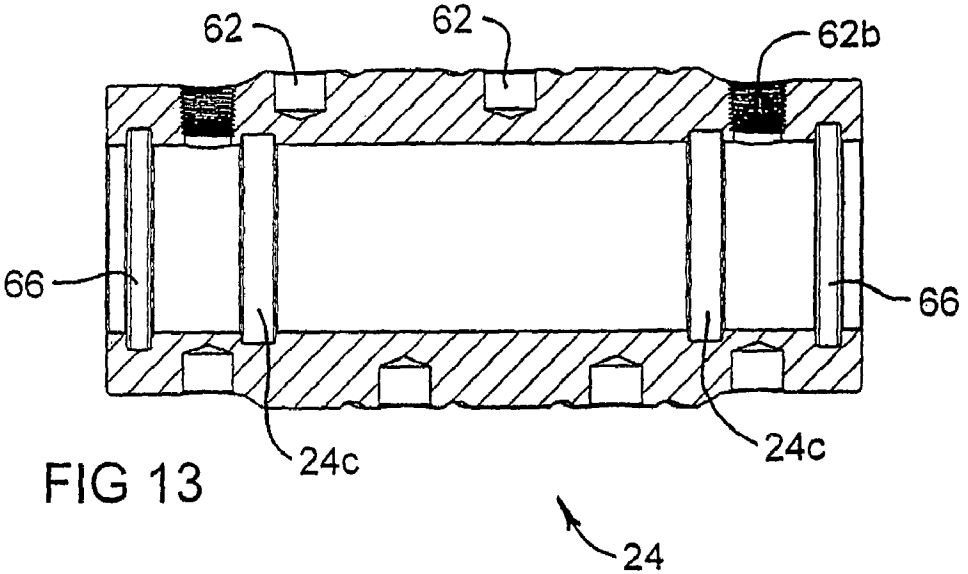
FIG. 13 is a longitudinal cross sectional view of the crushing roller shown in FIG. 12.
Figure 14:
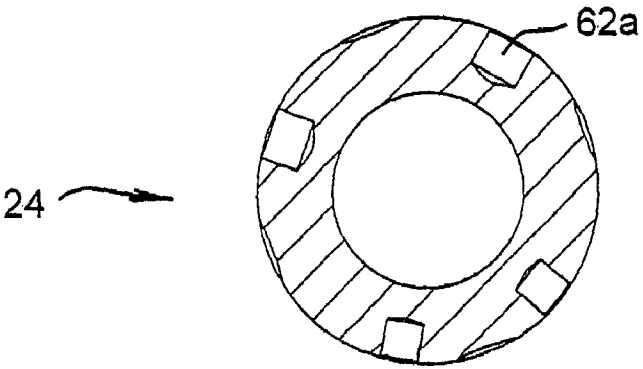
FIG. 14 is an end view of the crushing roller shown in FIG. 12.
Figure 15:
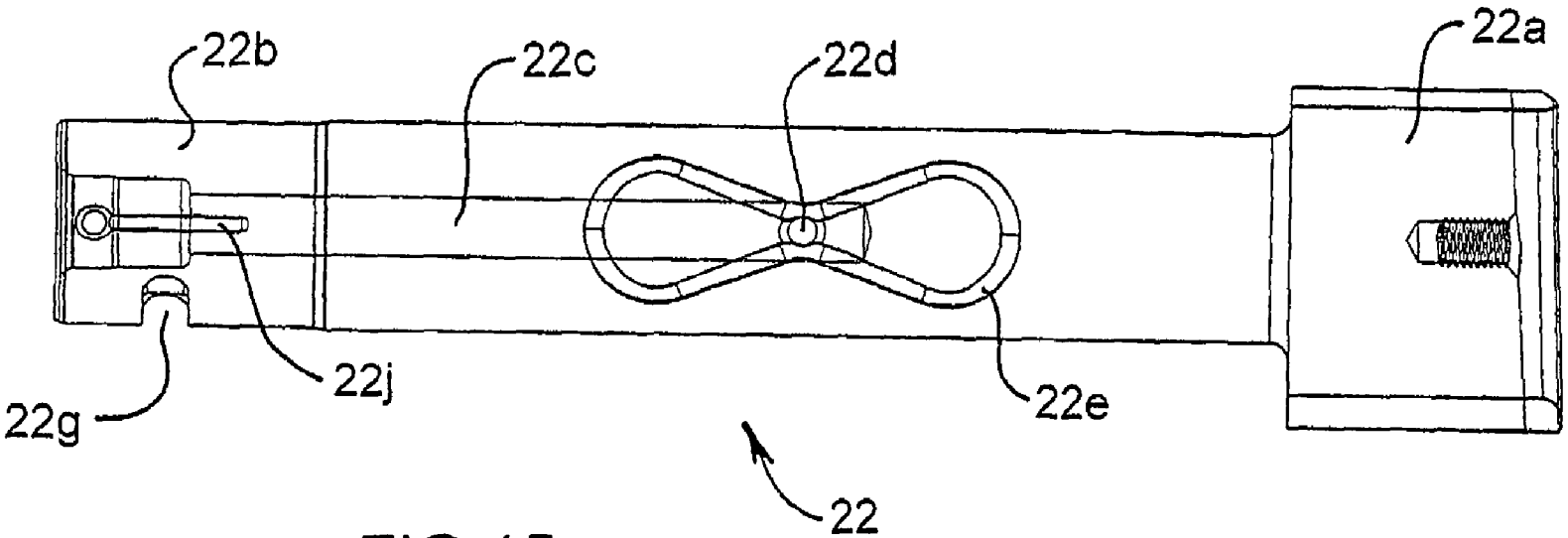
FIGS. 15 to 17 are views of a roller pin in accordance with an embodiment of the invention.

FIGS. 12 to 14 illustrate the crushing roller 24. The crushing roller 24 is formed as a hollow cylindrical member having a central bore which is sized to receive the shank of the roller pin 22. The crushing roller 24 has reduced diameter portions at each end for primary engagement of the crushing roller 24 with the walls of the well bore. A secondary engagement diameter is formed therebetween and is studded with a plurality of buttons 60 (not shown in FIGS. 12 to 14). The buttons 60 are preferably domed shaped tungsten carbide buttons that are each mounted within an aperture 62. The carbide buttons 60, in accordance with a preferred embodiment, are arranged in four rows of eight and are set on a left-hand 3.31699" pitch helix. Each row is separated by 90° of angular rotation and the starting point for each row commences in a progressive step equal to $0.125\times\frac{1}{8}^{th}$ of the helical datum curve length. Each button 60 is spaced at $\frac{1}{8}^{th}$ of the helical curve length.

It will be appreciated by those skilled in the art that the above arrangement of buttons 60 on the crushing roller 24 provides a very efficient use of the carbide buttons and thus significantly less carbide is used. This reduction in carbide use is also expected to reduce the torque loading in the drill string. It will further be appreciated that other arrangements of the carbide buttons on the crushing roller are envisaged. Advantageously, the carbide buttons are arranged so that during use they provide substantially complete coverage of the portion of the wall of the well or drill hole being reamed. In other words, the contact area of the various carbide buttons with the portion of the drill hole being reamed overlaps.

Located between each of helically spaced rows of buttons 60 are flutes 64. There are four flutes 64 and they are generated on the same helical datum path as the apertures 62. The flutes 64 are arranged to enable increased mud flow past the crushing roller 24 and to increase the clearance through which the crushing residue from the rotary roller reamer 10 can pass.

The inclusion of primary engagement diameters at the respective ends 24*a*, 24*b* of the crushing roller 24 enables the rotary roller reamer 10 to be bi-directional (i.e. either up hole or down hole in its application). Seven holes 62*a* are located in each primary diameter for the insertion of further domed tungsten carbide buttons 60*a*. The holes 62*a* are equally spaced and circumferentially drilled on the surfaces normal to the roller central axis.

As illustrated in FIG. 12, a further hole 62*b* drilled through to the central bore is formed in each of the primary engagement diameters. Each hole 62*b* is tapped with a female thread and is arranged to receive a pressure plug 63. Each hole 62*b* has the dual function of a grease injection port and a purge port. The use of the pressure plugs 63 will be described in more detail subsequently.

As illustrated in FIG. 13, a pair of seal retention grooves 66 is formed within the wall of the central bore of the crushing roller 24 and are arranged to receive respective seals 34*a*, 34*b*. As shown, the seals 34*a*, 34*b* are simple o-rings. However, the use of other types of seals is envisaged.

Figure 23:
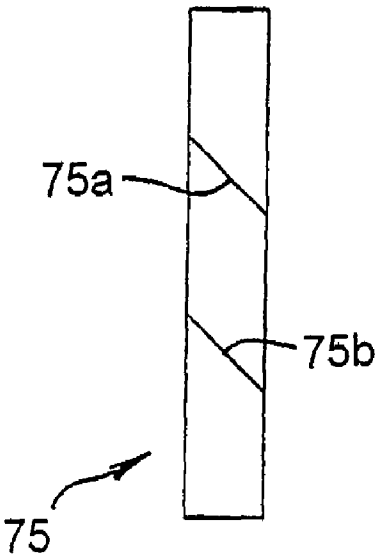
FIG. 23 is a side view of the stabilization band shown in FIG. 21.
Figure 22:
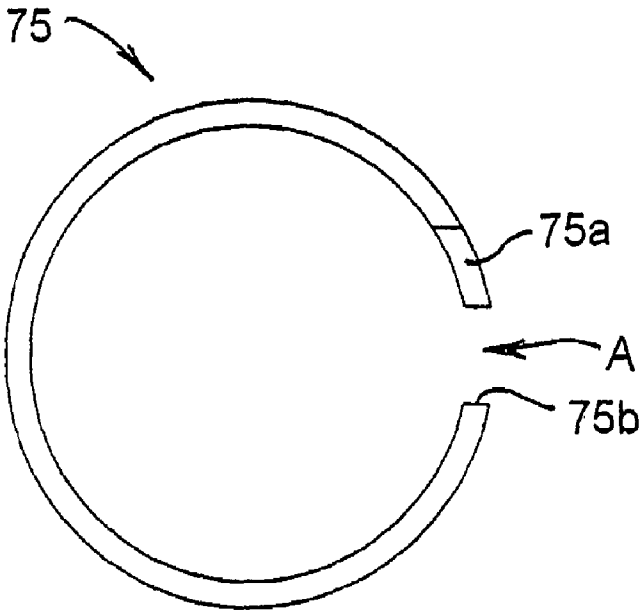
FIG. 22 is a front view of the stabilization band shown in FIG. 21.
Figure 21:
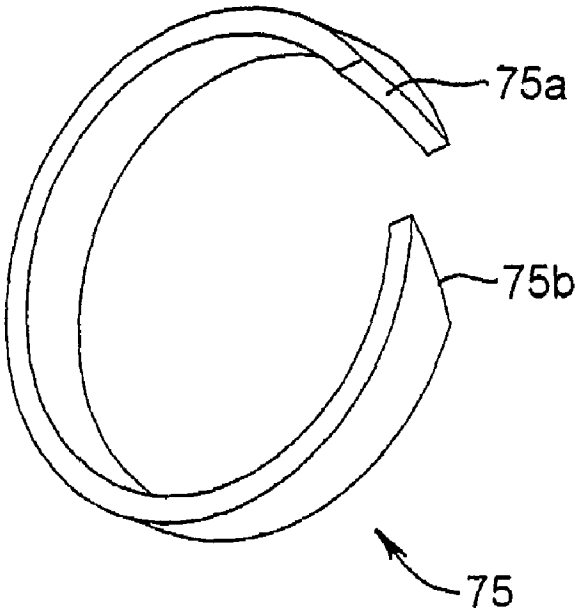
FIG. 21 is a perspective view of the stabilization band shown in FIG. 1A.

Also shown in FIG. 13 are further annular grooves 24*c* intermediate the ends of the bore of the crushing roller 24. Each groove 24*c* is arranged to receive a stabilizing band 75. As best illustrated in FIG. 21, each stabilization band 75 is a band which is broken at point A to provide a gap between the respective ends 75*a*, 75*b* of the band. The ends 75*a*, 75*b* terminate at an angle of about 45° (See FIG. 23). Termination at other angles is envisaged.

Each stabilization band 75 is sized to provide a minimal running fit about the shank of the roller pin 22 and to float within its respective groove 24*c*. Thus, the stabilization band 75 may either be rotatable with the roller pin 22 or with the crushing roller 24.

Such a stabilizing band 75 is preferably made of a material that is reasonably hard and has a relatively low coefficient of friction. This material may be a fluroropolymer selected from the range of polytetrafluorethylenes (PTFE) marketed by DuPont under the TEFLON® trade mark. However, more preferably, such a material will be strengthened by the addition of a filler, such as with a glass, bronze or nickel filler. Ideally, the material will be a bronze filled PTFE.

In this form, the stabilizing band 75 tends to assist in maintaining the rotation of the roller pin 22 substantially stable about its longitudinal axis and along its entire length. In this respect, in some situations, a seals 34*a*, 34*b* may be somewhat sensitive to end-to-end bounce of the roller pin 22, such as would normally be expected due to the reasonably severe impact compression encountered by the roller assembly 20 during operation. The additional use of a stabilizing band 75 of this general type will thus assist with the smooth operation of the roller assembly 20.

Figure 16:
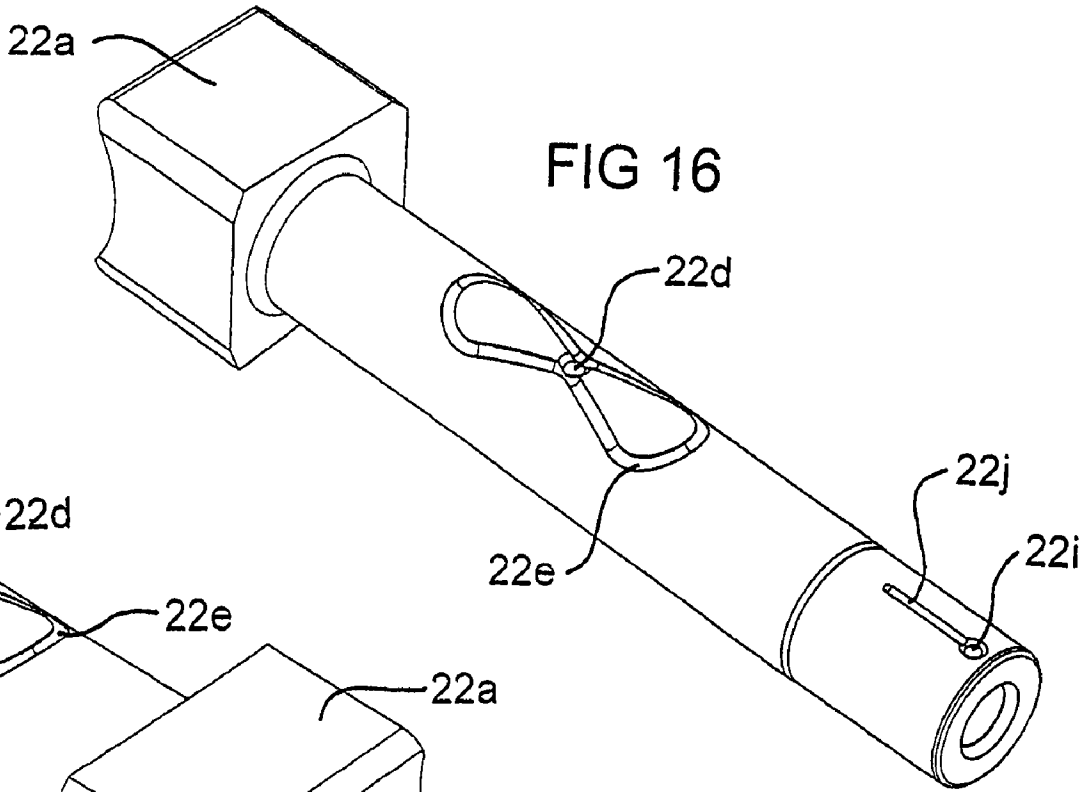
Figure 17:
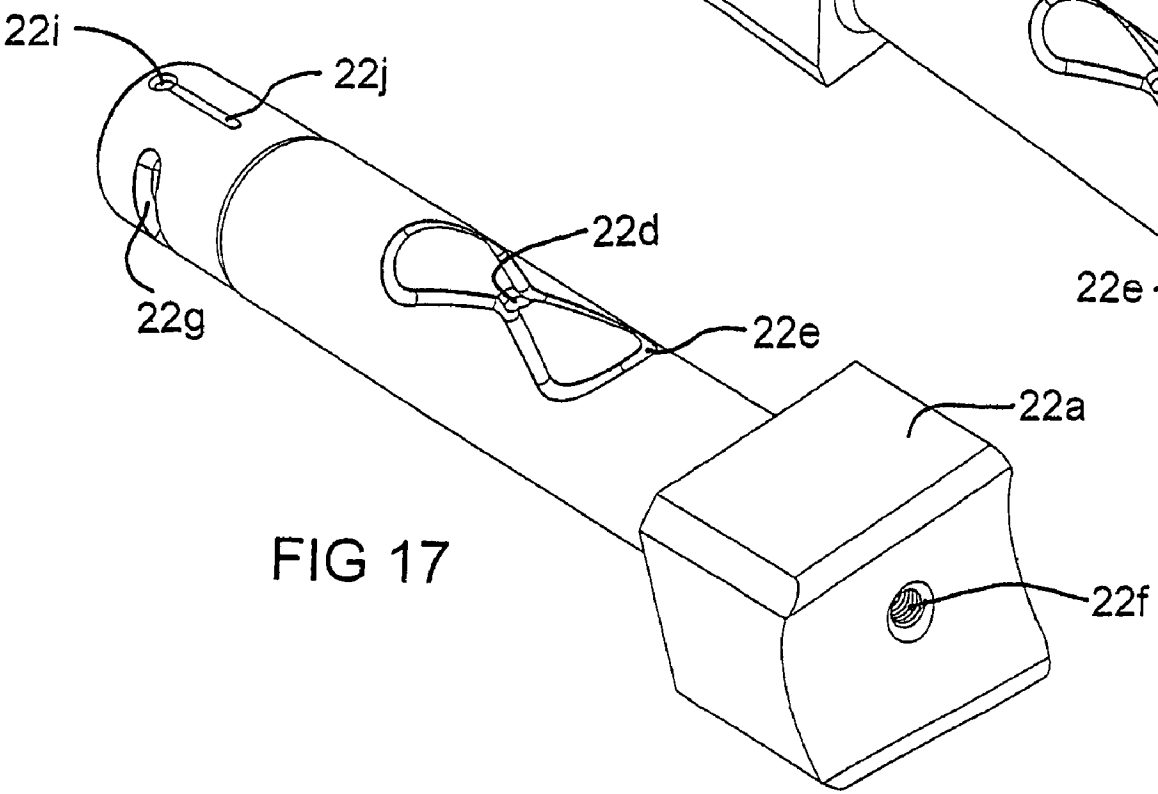

FIGS. 15 to 18 illustrate the roller pin 22. The roller pin 22 includes a central longitudinal bore 22*c* (best shown in FIGS. 3 and 15) that opens through the lower end 22*b*. The bore 22*c* in the shank of the roller pin 22 forms a lubricant reservoir. A side port 22*d* extends between the lubricant reservoir 22*c* and a primary lubricant distribution groove 22*e*. The primary lubricant distribution groove 22*e* extends longitudinally of the roller pin 22. As best shown in FIGS. 16 and 17, the primary lubricant distribution groove 22*e* is formed in a "FIG. 8" configuration.

It will be appreciated that the lubricant reservoir 22*c* enables a lubricant to be stored in the roller pin 22 and subsequently supplied, via the side port 22*d*, to the distribution groove 22*e* during rotation of the crushing roller 24 about the roller pin 22. The lubricant is distributed over the shank of the roller pin 22 as the crushing roller 24 rotates thereabout. The seals 34*a*, 34*b* retain the lubricant on the shank of the roller pin 22.

A second side port 22*i* is located adjacent the second end 22*b* of the roller pin 22 and intersects with the lubricant reservoir 22*c*. The side port 22*i* opens into a groove 22*j*. The function of the groove 22*j* and the side port 22*i* will be described below.

Also formed adjacent the second end 22*b* of the roller pin 22 is a transverse retaining slot 22*g*. The retaining slot 22*g* is arranged so that the leading end of the retaining screw 29 in the second retainer 28 can be located in the retaining slot 22*g*. In this manner, the roller pin 22 can be oriented relative to the second retainer 28. The use of a retaining slot 22*g* enables limited rotation of the roller pin 22 after connection to the second plug 28.

Figure 20:
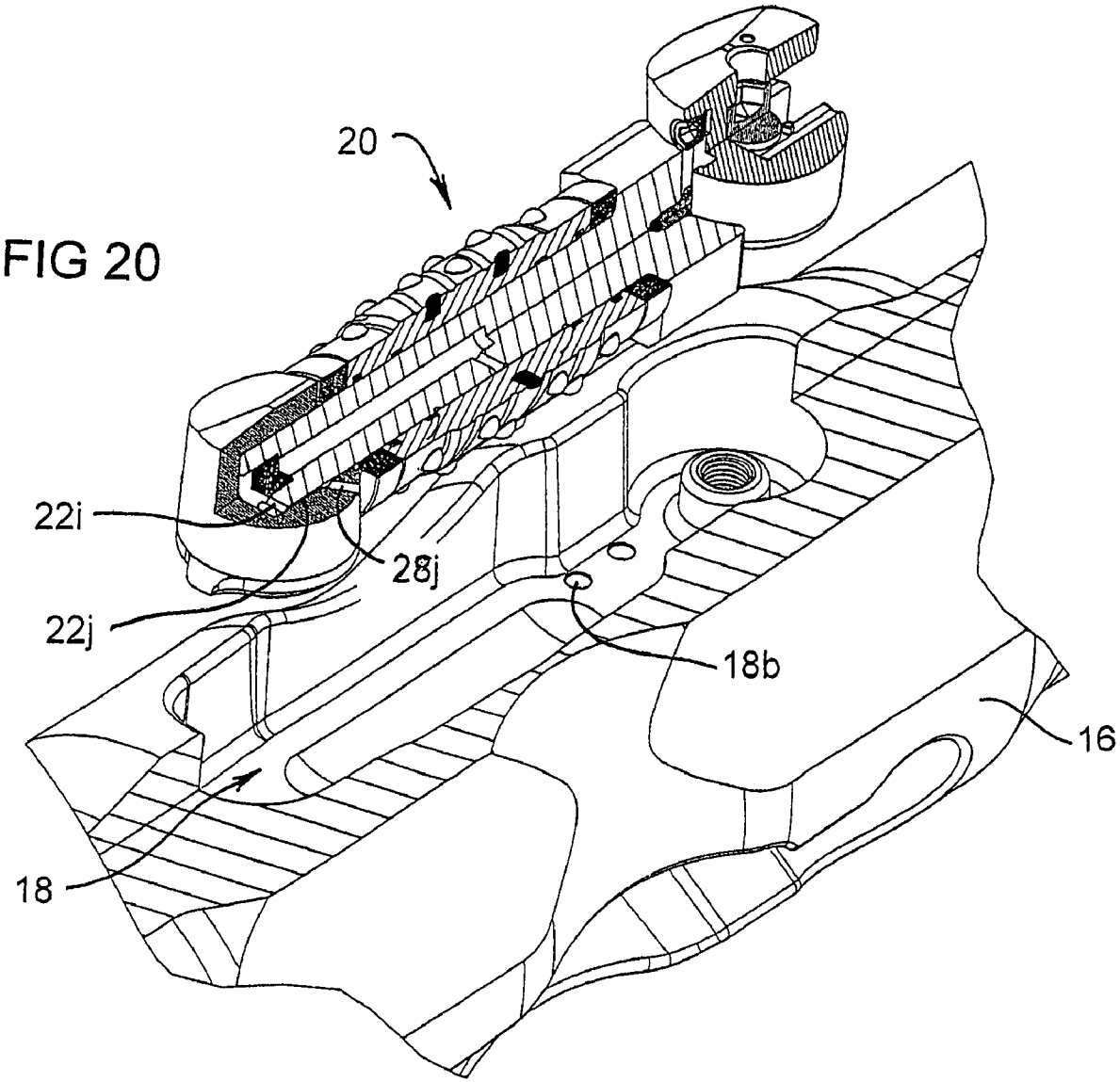
FIG. 20 is a partial cross sectional view showing insertion of a roller cartridge (i.e. the assembled roller assembly) into a pocket of the rotary reamer.

As best shown in FIGS. 3 and 20, the pressure equalizer 36 is positioned against a counter bore formed in the lubricant reservoir 22*c*. When the roller cartridge 20 is located in the pocket 18, the portion of the lubricant reservoir 22*c* to the right side (as shown in FIG. 3) of the pressure equalizer 36 opens into the bore 28*e* of the second plug 28. The second side port 22*i* of the roller pin 22 opens into the groove 22*j* (FIG. 20) which in turn aligns with the minor bore 28*j* formed in the second plug 28. The minor bore 28*j* of the second plug 28 opens to the area surrounding the crushing roller 24. Thus, it will be appreciated that there is a pressure flow path from the area surrounding the crushing roller 24 to pressure equalizer 36.

The pressure equalizer 36 acts to ensure that the pressure of the lubricant within the bearing cavity (i.e. the clearance between the roller pin 22 and the crushing roller 24) is substantially equal to the pressure of the drilling mud which completely envelopes the rotary roller reamer 10 during a reaming operation. It is important to equalize this pressure so as to prevent the seals 34*a*, 34*b* from blowing in or out.

The pressure equalizer may take the form of a filter 36. In one embodiment, the filter 36 may be a sintered metal filter. The sintered metal filter may have an alloy composition of 68% copper, 27% nickel and 5% tin and a micron capture equal to or about 30 μm. The pressure equalizer may adopt other configurations.

Figure 18:
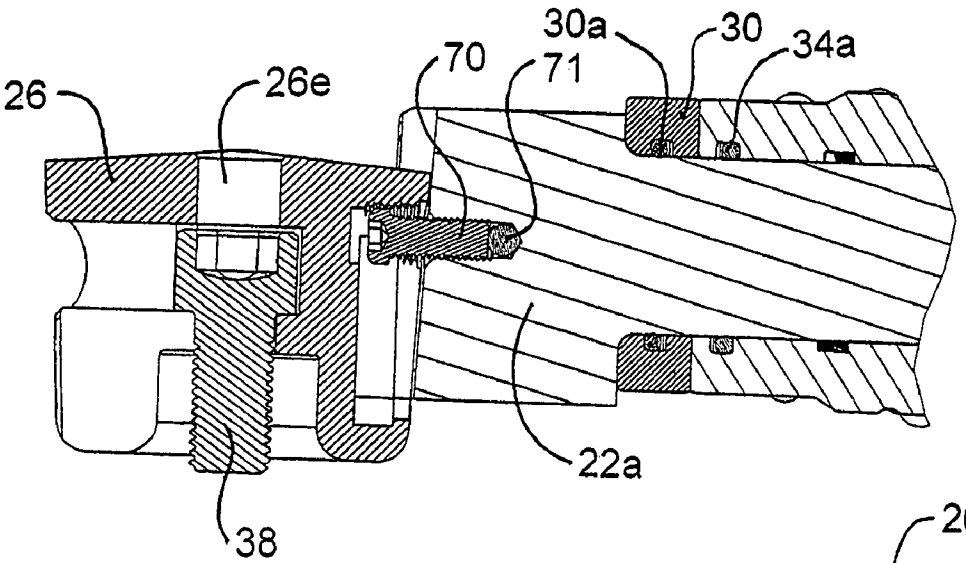
FIG. 18 is a cross sectional view showing connection of the first retainer to the connector screw which extends from the enlarged head of the roller pin.

As best illustrated in FIGS. 3, 18 and 19 the head 22*a* of the roller pin 22 is shaped to mate with the sidewall 26*b* of the first plug 26. Thus, the head 22*a* is configured as a flanked trapezium shaped solid with a conical cut in its outer face.

The head 22*a* includes a blind bore 22*f* which is coincident with the elongate axis of the roller pin 22. The bore 22*f* is threaded to enable connection of the connector pin 70 thereto. This connection will be described in detail subsequently.

The first thrust ring 30 is formed as a solid ring of low friction metal or reinforced polymer which bears against the roller side face of the head 22*a* of the roller pin 22 and the face of the first end 24*a* of the crushing roller 24. The first thrust ring 30 is designed to accept the vertical thrust imparted from the sidewalls of the drill hole on the crushing roller 24 as a result of the rotating upward travel of the rotary roller reamer 10. The first thrust ring 30 is a sacrificial thrust ring.

The first thrust ring 30 has an internal o-ring seal 30*a* arranged to provide a small amount of shock absorption between the inside diameter of the thrust ring 30 and the shank of the roller pin 22. The o-ring seal 30*a* also acts as a barrier to the flow of drilling mud.

The second thrust ring 32 is a solid ring of low friction metal or reinforced polymer which bears against the second end 24*b* or the crushing roller 24 and the face of the second plug 28. The second thrust ring 32 is designed to accommodate the vertical thrust imparted from the sidewalls of the drill hole on the crushing roller 24 as a result of the rotating downward travel of the rotary roller reamer 10 within the hole being drilled. The second thrust ring 32 is a sacrificial thrust ring.

The second thrust ring 32 has an internal o-ring seal 32*a* arranged to provide a small amount of shock absorption between the inside diameter of the thrust ring 32 and the shank of the roller pin 22. The o-ring seal 32*a* also acts as a barrier to the flow of drilling mud.

The o-ring seals 32*a*, 32*b* are preferably made of a fluoroelastomeric compound.

The assembly process for a roller assembly 20 is as follows. A first thrust ring 30 is slid along the shank of the roller pin 22 until it abuts the head 22*a* of the roller pin 22. A crushing roller 24 with seals 34*a*, 34*b* and stabilization bands 75 in position and carbide tips 60 fitted, is then slid onto the shank of the roller pin 22 until the first end 24*a* of the crushing roller 24 abuts the first thrust ring 30. The filter 36 is then seated against the counter bore of the lubricant reservoir 22*c*.

At this stage, grease is injected into the crushing roller 24 via one of the holes 62*b* ("the first hole 62*b*"). The grease is injected until grease flows through the hole 62*b* (the "second hole 62*b*") in the other primary engagement diameter of the crushing roller 24. A pressure plug 63 is then installed to seal off the second hole 62*b*.

Grease injection is continued until lubricant flows through the lubricant reservoir 22*c* and out through the pressure equalization filter 36. At this point, the grease injection equipment is removed and a pressure plug 63 is fitted in the first hole 62*b*.

The second thrust ring 32 is then positioned on the shank of the roller pin 22 until it abuts with the second end 24*b* of the crushing roller 24. Finally, the second plug 28 is slid onto the end of the roller pin 22 so that the trailing end of the second thrust ring 32 is located flush against the flat portion of the sidewall 28*d* of the second plug 28. The retaining screw 29 is then located in the threaded aperture 28*f* and screwed inwardly so that it locates within the retaining slot 22*g* formed in the shank of the roller pin 22.

The fastener 38 is then inserted in the fastener-receiving cavity 26*c* of the first plug 26 and held in position by the self locking pins 38*a*.

A steel ball 71 is then dropped in the blind bore 22*f*. A connector screw 70 is then screwed into the bore 22*f* until it is firmly set against the steel ball 71. This action ensures a constant depth of engagement of the first plug 26 to the roller pin 22. The head 70*a* of the connector screw 70 is then passed through the upper portion 26*f* of the connector screw slot 26*f* in the first plug 26. Connection between the first plug 26 and the roller pin 22 is maintained by inserting a retaining plug 72 in the threaded upper portion 26*f'* of the connector screw slot 26*f*. The retaining plug 72 prevents the head 70*a* of the connector screw 70 from inadvertently withdrawing from the connector screw slot 72.

The positioning of the connector screw 70 in the connector screw slot 26*f* of the first plug 26 is best illustrated in FIG. 18. The insertion of the retaining plug 72 in the threaded upper portion 26*f'* of the connector screw slot 26*f* is best illustrated in FIG. 19.

As will be apparent, the connection between the head 22*a* of the roller pin 22 and the first plug 26 is such as to allow limited articulation of the first plug 26 relative to the roller pin 22, whilst still ensuring proper alignment of the plug 26 relative to the roller pin 22 when the roller cartridge 20 is fitted into a pocket 18 of the rotary roller reamer 10.

Once the components of the roller assembly 20 have been assembled, the roller cartridge, as it is then known, forms a single cartridge which is ready for insertion into a pocket 18 of the rotary reamer 10.

A roller cartridge 20 is fitted within a pocket 18 of the rotary roller reamer 10 as follows. Firstly, the roller cartridge 20 is held horizontally so that the second plug 28 is located in a forward position facing the end of the lower tapered socket 40. The roller cartridge 20 is then tilted towards the floor 18*a* of the pocket 18. It is then lowered into the pocket 18 until the second plug 28 contacts the floor 18*a* of the pocket 18. The roller cartridge 20 is then slid forward and down into the pocket 18 until the second plug 28 is seated in the lower tapered socket 40.

During positioning of the second plug 28 in the lower tapered socket 40, the first plug 26 aligns itself relative to the roller pin 22 and the upper tapered socket 46 so that it is properly positioned within the pocket 18 ready to be fastened in position by the fastener 38. This "self aligning" characteristic of the first plug 26 is a consequence of the nature of the connection between the first plug 26, the connector screw 70, the steel ball 71 and the head 22*a* of the roller pin 22.

A hex driver is then inserted through the aperture 26*d* in the first plug 26 and the fastener 38 is screwed into the threaded bore 54 of the post 52 formed in the floor 18*a* of the pocket 18. As the fastener 38 is screwed into the bore 54 the first plug 26 is drawn into the upper tapered socket 46. FIG. 20 illustrates a roller cartridge 20 being fitted into a pocket 18 of a rotary roller reamer 10.

It will be appreciated by those skilled in the art that different numbers of pockets 18 may be provided on the reamer body 16. Additionally, although the pockets 18 are described as being equally spaced about the periphery of the reamer body, this need not always be the case. They may for example be spaced by an exponential or logarithmic value.

It will also be appreciated that the crushing roller 24 may include different arrangements and numbers of primary engagement diameters (i.e. may adopt a multi step form), carbide buttons, flutes and helixes.

The described embodiment of the invention is advantageous because:

1. Each roller cartridge 20 is retained in its respective pocket 18 using a single locking device (e.g. the bolt 38).
2. Each roller cartridge 20 can be easily fitted and removed from its respective pocket 18 because the roller cartridge 20 is fitted as a single "one" piece assembly. This enables quick insertion and removal of the roller cartridge 20 from a pocket 18 and thus helps minimize down time of a rotary reamer 10 due to maintenance requirements.
3. The arrangement of the first retainer (first plug) 26 is such that tightening of the fastener 38 draws the first retainer 26 into the pocket 18 and loosening of the fastener lifts the first retainer 26 and thus the entire roller assembly 20 out of the pocket 18. This ensures easy removal of the roller cartridge 20 even in the worst of on-site conditions.
4. The necked down portion of the reamer body 16 adjacent the crushing roller 24 facilitates relief of torsional stress that would otherwise be concentrated in this area of the reamer body 16. The necked down portion also enable superior mud flow through the primary mud ways milled between the pockets 18 and through and over the pockets 18. The necked down portion also provides a uni-directional path linking each mud way should any one be obstructed during use of the rotary roller reamer 10.

5. The arrangement of the carbide buttons 60, 60*a* on the crushing roller 24 reduces the amount of carbide used whilst maintaining required performance. Additionally, it is envisaged that the arrangement of carbide buttons may serve to reduce the torque loading in the drill string.
6. The described pressure equalization arrangement and in particular, the use of the filter 36 in the lubricant cavity 22*c*, improves the operational life of the roller assembly 20.
7. The load forces on the rotary roller reamer are all substantially longitudinal in direction rather than transversally. This results in a longer working life for the rotary roller reamer.
8. During use, the rotary roller reamer will rotate towards the right (i.e. clockwise when viewed looking down the well bore). The crushing rollers 24 on engagement with the well bore will rotate towards the left. As the drill bit on the end of the drill string loses diameter through normal operational wear, the reamer will through its rolling and crushing action ensure the integrity of the gauge size of the well bore diameter for a period in excess of the drill bits ability to maintain the required bore gauge. Hence, the use of rotary reamers in accordance with embodiments of the invention reduces the frequency of complete removal of the drill string from the well bore in order to change out the drill bit.
9. The roller cartridge 20 can be supplied on site, ready for use, without any further component assembly required.

The embodiments have been described by way of example only and modifications within the spirit and scope of the invention are envisaged.

What is claimed is:

1. A roller assembly for a rotary roller reamer, said roller assembly including a roller pin, a roller arranged to be mounted on said roller pin, a first retaining means and a second retaining means, said roller pin having an enlarged head arranged for connection to said first retaining means and an end arranged to be received within an aperture formed in the second retaining means, said end being secured to said second retaining means by a retaining screw that engages within a slot formed in the roller pin, and wherein said roller pin, roller, first retaining means and second retaining means connect together to form a cartridge that can be inserted into a pocket of the rotary roller reamer and secured thereto by a single fastener that engages with the first retaining means.

2. A roller assembly for a rotary roller reamer, said roller assembly including a roller pin, a roller arranged to be mounted on said roller pin, first retaining means and second retaining means, said roller pin having a head arranged for articulated connection to said first retaining means and an end arranged to be received in an aperture formed in the second retaining means, said end being secured to said second retaining means by securing means, and wherein said roller pin, roller, first retaining means and second retaining means are arranged to be connected together so as to form a cartridge that can be inserted into a pocket of the rotary roller reamer and secured thereto by a single fastener device, said first retaining means including a first plug which connects to the roller pin so that the roller pin, roller and first plug form said single cartridge which can be inserted into the pocket of the rotary roller reamer, wherein the first plug has a first surface against which a first end of the roller pin mates and a second surface arranged to engage with a sidewall of said pocket, said sidewall of said pocket and said second surface of said first plug being configured so that the first plug is drawn into the pocket when said single fastener device is used to secure the cartridge to said pocket.

3. A roller assembly according to claim 2 wherein the first plug includes a base having an underside shaped to engage with a mating portion of the pocket.

4. A roller assembly for a rotary roller reamer, said roller assembly including a roller pin, a roller arranged to be mounted on said roller pin, first retaining means and second retaining means, a first thrust ring located between the roller pin and a first end of the roller and a second thrust ring located between a second end of the roller and said second retaining means, said roller pin having a head arranged for articulated connection to said first retaining means and an end arranged to be received in an aperture formed in the second retaining means, said end being secured to said second retaining means by securing means, and wherein said roller pin, roller, first retaining means and second retaining means are arranged to be connected together so as to form a cartridge that can be inserted into a pocket of the rotary roller reamer.

5. A roller assembly according to claim 4 wherein the first and second thrust rings are sacrificial thrust rings.

6. A roller assembly according to claim 4 wherein the first surface of the first plug is complementary to the first end of the roller pin.

7. A roller assembly according to claim 6 wherein the roller pin includes a shank having a central longitudinal blind bore formed therein that opens through a second end of the roller pin.

8. A roller assembly according to claim 7 wherein the bore forms a lubricant reservoir and includes a side port that extends substantially perpendicular thereto and opens into a primary lubricant distribution groove.

9. A roller assembly according to claim 8 wherein the primary lubricant distribution groove extends substantially longitudinally of the roller pin.

10. A roller assembly according to claim 7 further including seal means provided between the crushing roller and the shank of the roller pin.

11. A roller assembly for a rotary roller reamer, said roller assembly including a roller pin, a roller arranged to be mounted on said roller pin, first retaining means and second retaining means, said roller pin having a head arranged for connection to said first retaining means and an end arranged to be received in an aperture formed in the second retaining means, said end being secured to said second retaining means by securing means, and wherein said roller pin, roller, first retaining means and second retaining means are arranged to connect together so as to form a cartridge that can be inserted into a pocket of the rotary roller reamer and secured thereto, said cartridge being arranged to be secured to said pocket by a fastener that engages with said first retaining means, wherein the first retaining means includes a first plug having a fastener-receiving cavity that opens through a sidewall and base thereof, said fastener-receiving cavity being arranged to receive the fastener.

12. A roller assembly according to claim 11 wherein the first plug further includes an elongated screw connector slot formed in the sidewall thereof, said screw connector slot being configured to receive a head of a screw arranged to be connected to a head of the roller pin.

13. A roller assembly according to claim 12 wherein the first plug further includes an aperture opening into said fastener-receiving cavity which is arranged so that a tool can be passed there through to enable the fastener to be screwed into a mating portion of the pocket.

14. A roller assembly according to claim 11 wherein the roller includes at least one lubricant entry hole and plug means for plugging said lubricant entry hole, said lubricant entry hole being arranged so that lubricant can be supplied to the roller pin.

15. A rotary roller reamer including a reamer body and at least one roller assembly in accordance with claim 11 and wherein said reamer body has at least one pocket for receiving said at least one roller assembly.

16. A roller assembly for a rotary roller reamer, said roller assembly including a roller pin, a roller arranged to be mounted on said roller pin, first retaining means and second retaining means, said roller pin having a head arranged for connection to said first retaining means and an end arranged to be received in an aperture formed in the second retaining means, said end being secured to said second retaining means by securing means, and wherein said roller pin, roller, first retaining means and second retaining means are arranged to connect together so as to form a cartridge that can be inserted into a pocket of the rotary roller reamer and secured thereto, said cartridge being arranged to be secured to said pocket by a fastener that engages with said first retaining means, wherein the second retaining means includes a second plug having a major bore formed substantially perpendicular to the central longitudinal axis of the second plug, said major bore being arranged to receive an end of the roller pin, wherein the second plug further includes a minor bore having a first end opening into said major bore and a second end opening onto an area surrounding the roller when the roller assembly is fitted in a rotary roller reamer.

17. A roller assembly according to claim 16 wherein the second plug further includes an aperture arranged to receive said securing means for securing the end of the roller pin within the second plug.

18. A roller assembly according to claim 17 wherein the securing means includes a retaining screw.

19. A roller assembly according to claim 16 wherein the roller pin includes a side port which extends between a lubricant reservoir and the minor bore in the second plug.

20. A roller assembly for a rotary roller reamer, said roller assembly including a roller pin, a roller arranged to be mounted on said roller pin, first retaining means and second retaining means, said roller pin having a head arranged for connection to said first retaining means and an end arranged to be received in an aperture formed in the second retaining means, said end being secured to said second retaining means by securing means, and wherein said roller pin, roller, first retaining means and second retaining means are arranged to connect together so as to form a cartridge that can be inserted into a pocket of the rotary roller reamer and secured thereto, said cartridge being arranged to be secured to said pocket by a fastener that engages with said first retaining means, wherein the second retaining means includes a second plug having a major bore formed substantially perpendicular to the central longitudinal axis of the second plug, said major bore being arranged to receive an end of the roller pin, wherein the second plug further includes a lug arranged to engage with a complementary shaped recess formed in a portion of the pocket.

21. A roller assembly for a rotary roller reamer, said roller assembly including a roller pin, a roller arranged to be mounted on said roller pin, first retaining means and second retaining means, said roller pin having a head arranged for connection to said first retaining means and an end arranged to be received in an aperture formed in the second retaining means, said end being secured to said second retaining means by securing means, and wherein said roller pin, roller, first retaining means and second retaining means are arranged to connect together so as to form a cartridge that can be inserted into a pocket of the rotary roller reamer and secured thereto, said cartridge being arranged to be secured to said pocket by a fastener that engages with said first retaining means, said roller including a central portion and first and second end portions, the central portion having an external diameter greater than the external diameter of the first and second portions, the central, first and second portions being studded with projection means, the projection means on the central portion being arranged in four rows of eight and are set on a left-hand 3.31699" pitch helix, each row separated by 90° of angular rotation, the starting point for each row commencing in a progressive step equal to 0.125×⅛th of the helical datum curve length and each projection means being spaced at ⅛th of the helical curve length, wherein a flute is located between each of the helically spaced rows which are generated on the same helical datum path as the projection means.

* * * * *